United States Patent [19]

Cherbourg et al.

[11] 3,993,339

[45] Nov. 23, 1976

[54] PLATE-TYPE DOOR OPENING CONTROL DEVICE

[75] Inventors: Robert Cherbourg; Guy Soetaert, both of Boulogne-Billancourt, France

[73] Assignees: Regie Nationale des Usines Renault, Boulogne-Billancourt; Automobiles Peugeot, Paris, both of France

[22] Filed: July 22, 1975

[21] Appl. No.: 598,033

[30] Foreign Application Priority Data

July 26, 1974 France ..... 74.26065

[52] U.S. Cl. ..... 292/336.3

[51] Int. Cl.[2] ..... E05C 21/00

[58] Field of Search..... 292/336.3, 200, 226, 292/100, 118, 126, 358, 169, 51, DIG. 18, DIG. 31, DIG. 62

[56] References Cited

UNITED STATES PATENTS 2,784,993 3/1957 Collar ..... 242/223

*Primary Examiner*—Richard E. Moore

[57] ABSTRACT

The invention relates to a device for controlling the opening and closing of a door, whether hinged or sliding, from both outside and inside, said device comprises, mounted on a common shaft, a first control plate replacing the conventional handle and rotatably rigid with said shaft, said first plate being housed in an external case, and another control plate mounted for loose rotation on said shaft and housed in an internal case, means being provided for interconnecting said plates when being rotated in one direction.

5 Claims, 4 Drawing Figures

Fig-3
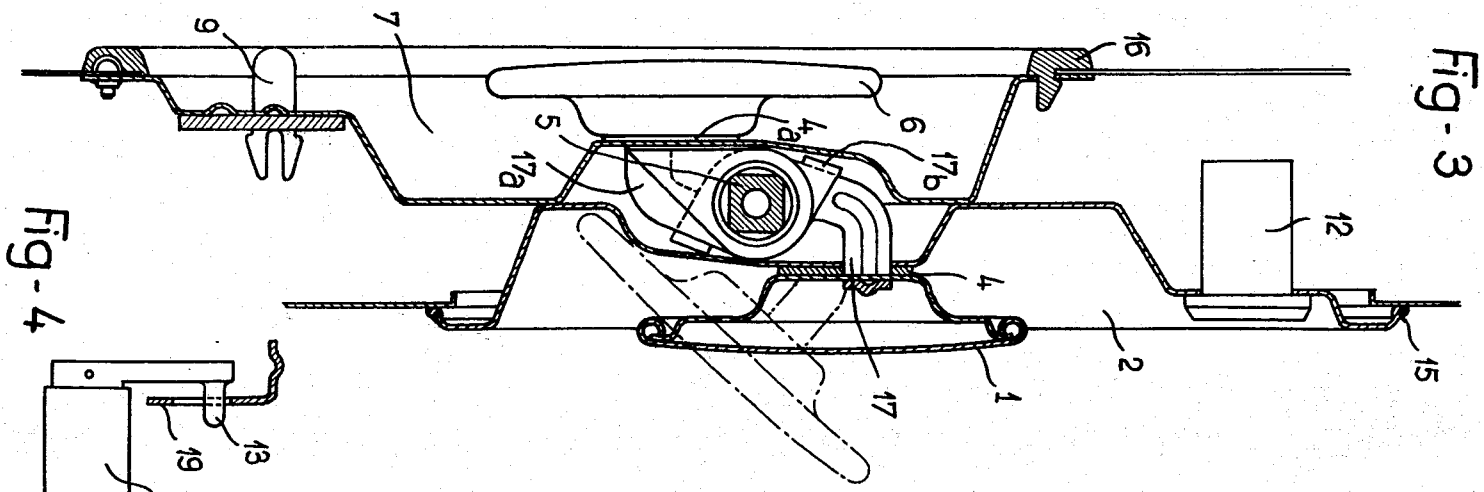
Fig-2
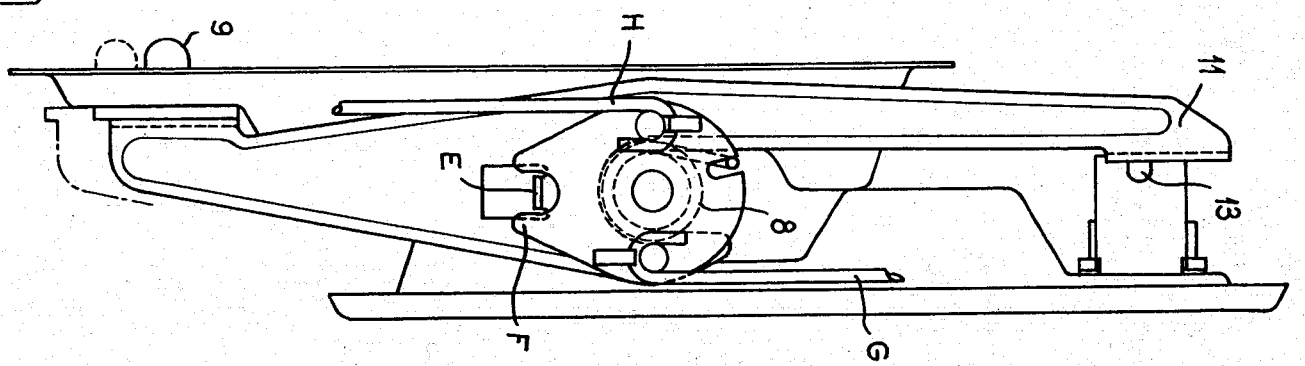
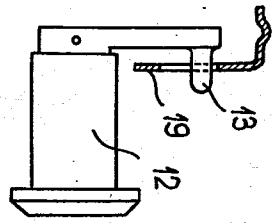
Fig-4

PLATE-TYPE DOOR OPENING CONTROL DEVICE

The present invention relates in general to devices for controlling the opening of a door by means of a pair of plates.

In hitherto known devices for opening doors from outside and from inside, conventional pivoted handles or pushbutton control members are used as a rule. In these devices the means interconnecting the internal and external opening control mechanisms require a relatively long fitting time.

It is the essential object of this invention to substitute an assembly of coaxial plates disposed symmetrically in relation to their fulcrum for the conventional handle systems.

More particularly, this invention is directed to a device for controlling the opening of a door from outside and inside, which is characterized in that it comprises a pair of control plates mounted on a common shaft and symmetrically in relation thereto, one plate being rotatably solid with said shaft and housed in an external case, the other plate being mounted for loose rotation on said shaft and housed in an internal case, means being also provided for operatively interconnecting these two plates when being rotated in one direction.

Another feature characterizing this control device is that it comprises a safety catch mechanism controlled from the inside by means of a knob and from the outside by means of a pin tumbler cylinder.

The control assembly and also the safety catch mechanism are part of a pre-assembled unit.

In order to afford a clearer understanding of this invention and of the manner in which the same may be carried out in practice, a preferred form of embodiment thereof will now be described by way of illustration, not of limitation, with reference to the accompanying drawing, in which:

FIG. 2 is a side elevational view taken in the direction of the arrow II of FIG. 1;

FIG. 3 is a section taken along the line III—III of FIG. 1, and

FIG. 4 is a side elevational view showing the pin tumbler cylinder provided for controlling the safety catch mechanism.

Figure 1:
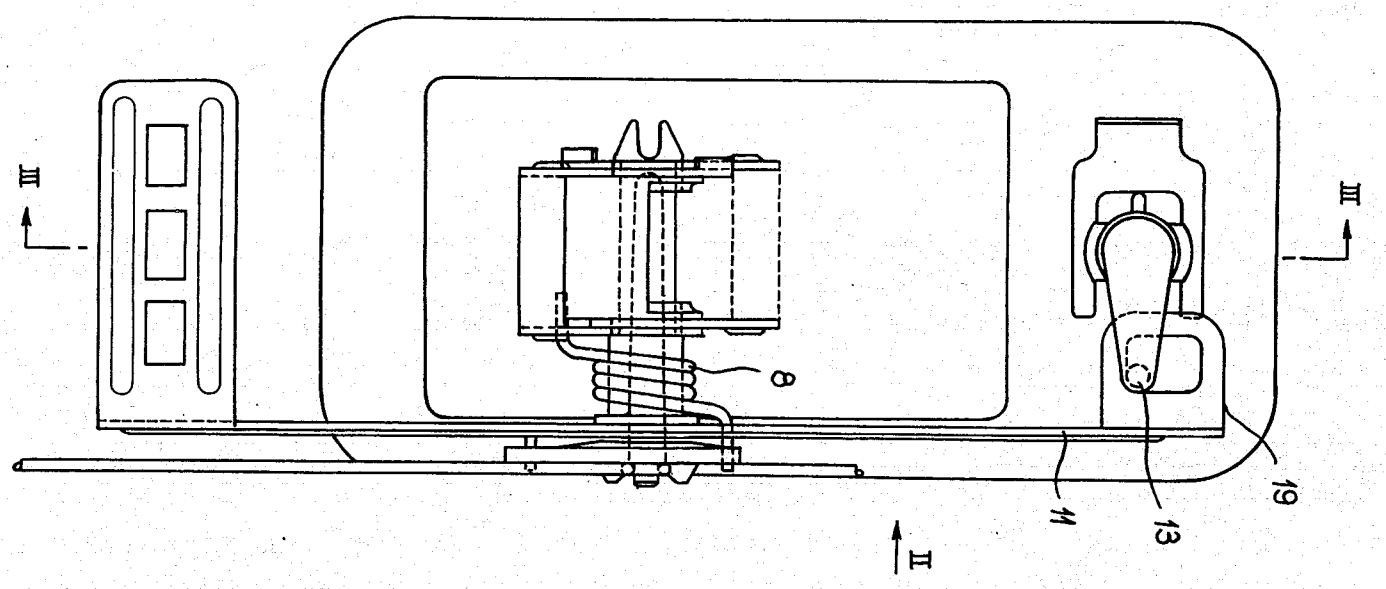
FIG. 1 is a front elevational view of the door control device according to this invention.

In an external case 2 a first plate 1 is arranged to bear against a flexible seal 4 and rotatably solid with a shaft 5 by means of a yoke 17. This plate 1 is constantly urged to its inoperative position by a spring 8.

In an internal case 7 another plate 6 bearing against a flexible seal **4*a* is mounted for loose rotation on the same shaft 5 symmetrically to the first plate 1 in relation to said shaft 5. This other plate 6 is supported by a yoke 17*a* carrying a lug 17*b* for interlocking the two yokes 17 and 17*a*** when being rotated in one direction.

The door safety catch mechanism comprises a main strip 11, a pin tumbler cylinder 12 and the driving pin 13 thereof; a fork 19 engaged by said pin 13 and a push-button 9 retained by snap action on said main strip 11.

The door opening control device according to this invention operates as follows:

a. Lock control mechanism

The door is opened from the outside by actuating the external plate 1. In fact, pivoting this plate 1 causes the shaft 5 to rotate, this shaft 5 having rods H and G anchored thereto. These rods actuate in turn the locks to be controlled by exerting a traction on a suitable component element of the corresponding lock.

During the pivotal movement of the external plate 1 the inner plate 6, which is free with respect to shaft 5, remains in its inoperative position.

The door is opened from inside the vehicle by pulling the lower portion of the inner plate 6. The direction of rotation is the same as for the outer plate.

The rotation of this inner plate 6 rotating loosely on shaft 5 is transmitted via tab **17*b* to the external plate 1 due to the fact that the yokes 17 and 17*a* rotate bodily with each other, said external plate 1 driving the shaft 5**.

The door is closed from the inside by using the upper portion of the inner plate 6.

b. Safety catch mechanism

The assembly is locked by holding the shaft 5 against rotation. The movement of translation of the main strip 11 is caused internally by the sliding movement of knob 9 and externally by the pin tumbler cylinder 12 and its driving pin 13.

The door control device according to the present invention is particularly advantageous for controlling the sliding or hinged doors of motor vehicles, but any other application may be contemplated within the scope of the invention as set forth in the appended claims. Furthermore, many modifications and changes may be brought to the specific form of embodiment described and illustrated herein without departing from the basic principles of the invention which are clearly apparent from the attached claims.

What is claimed as new is:

1. A device for controlling opening of a door from both outside and inside, said device comprising: a shaft, a first plate mounted on and for rotation with said shaft and located on one side of said door, a second plate mounted on said shaft for loose rotation on said shaft and being located on the other side of said door, and means for interconnecting said plates for rotation thereof in one direction about said shaft.

2. A device according to claim 1, comprising spring means for constantly urging said first plate to its inoperative position.

3. A device according to claim 1, wherein said second plate is provided with means for closing said door, said means being integral with said second plate and operable to open said door by being pulled in a direction opposite to said one direction.

4. An apparatus according to claim 3 comprising a safety catch mechanism including means for preventing said shaft from being rotated.

5. A device according to claim 1, comprising a first yoke connected to said first plate, a second yoke connected with said second plate, and wherein said interconnecting means comprises a tab fixably connected with said second yoke and adapted to bear against said first yoke.

* * * * *